United States Patent [19]

Haynes

[11] Patent Number: 4,531,481

[45] Date of Patent: Jul. 30, 1985

[54] ROTARY CYLINDER DIESEL ENGINE

[75] Inventor: Nolan F. Haynes, Millwood, W. Va.

[73] Assignees: James E. Casebolt, Jr.; Barion Casebolt, both of Nitro, W. Va.

[21] Appl. No.: 618,390

[22] Filed: Jun. 7, 1984

[51] Int. Cl.[3] ..... F02B 57/00

[52] U.S. Cl. ..... 123/44 R; 91/491

[58] Field of Search ..... 123/44 R; 91/197, 491, 91/493; 92/52, 66; 417/273

[56] References Cited

U.S. PATENT DOCUMENTS

| | | | |
|---|---|---|---|
| 1,215,922 | 2/1917 | Fasnacht | 123/44 R |
| 1,817,370 | 8/1931 | Hammerstrom | 123/44 R |
| 3,105,473 | 10/1963 | Johns et al. | 123/41.72 |
| 3,353,519 | 11/1967 | Reichart | 123/44 R X |
| 3,942,913 | 3/1976 | Bokelman | 91/491 X |

FOREIGN PATENT DOCUMENTS

| | | | |
|---|---|---|---|
| 666224 | 10/1938 | Fed. Rep. of Germany | 123/44 R |
| 337833 | 11/1930 | United Kingdom | 123/44 R |

*Primary Examiner*—Michael Koczo

*Attorney, Agent, or Firm*—Bernice W. Freundel

[57] ABSTRACT

A rotary 2-cycle diesel engine has five circumferentially spaced cylindrical combustion chambers orbiting in one direction for engagement with four spherical pistons mounted for parallel orbit in the opposite direction. The pistons and combustion chambers interact through a 72° arc of the combustion chamber while aspiration, exhaust and cooling are effected by centrifugal movement of the air during the remaining 288° arc. The connecting rods of the pistons are provided with a double bend and are geared for rotation to provide a longer piston stroke. A cam wheel and follower arrangement control the necessary piston orbiting speed fluctuation in relation to the combustion chambers' angular velocity.

12 Claims, 4 Drawing Figures

ROTARY CYLINDER DIESEL ENGINE

SUMMARY OF THE INVENTION

The present invention relates to the field of rotary diesel engines and more specifically to a two-stroke engine having orbiting combustion chambers interacting with orbiting spherical pistons. The improved engine disclosed is a fuel-injected rotary diesel having four spherical pistons mounted to orbit in one direction and five cylindrical combustion chambers mounted to orbit in the opposite direction. Of prime importance in this invention is the interaction of these rotors as they share a common arc of approximately 90° and 72° respectively.

The disclosed configuration permits a smaller piston orbit and in turn lets the piston penetrate farther into the combustion chamber resulting in a longer compression and power stroke. To facilitate the interdigitation of the pistons and combustion chambers the necessary piston-orbiting speed relative to the combustion chamber rotation is controlled by a cam wheel and follower arrangement. On the compression stroke the cam wheel transfers energy to the piston unit while on the power stroke the cam follower transfers energy to the combustion chamber unit. This arrangement also prevents lateral pressure by the piston to the sealing rings and walls of the combustion chambers.

The piston connecting rods are made with a double bend that provides clearance as the piston enters and exits from the combustion chamber. The connecting rods and pistons are also mounted for longitudinal rotation of 180° while orbiting 90°, which allows the rod's bend to be effective on both the leading and trailing edges of the combustion chamber.

An object of the invention is to provide a rotary engine that will produce high torque resulting from a long power stroke when compared to previous engines. The five power strokes per revolution will provide the engine with relatively high power at a low RPM and consequently will result in less weight per horsepower.

Another object of the invention is to provide a rotary engine in which the only reciprocating parts are the valve stems and valve springs. The particular configuration of the engine permits inspection and maintenance without disassembly. All the critical parts are exposed at one point or another during a revolution. In addition there are no exhaust valves as exhaust gases exit from the open end of the combustion chamber after the power stroke due to the centrifugal forces created. No cooling system is required as cooling is accomplished through aspiration. The embodiment of the invention shown produces an improved total combustion of fuel and a decrease in possible oil contamination.

Other features and advantages of the invention over prior art engines will become apparent during the course of the following detailed description.

DETAILED DESCRIPTION OF PREFERRED EMBODIMENT

Figure 1:
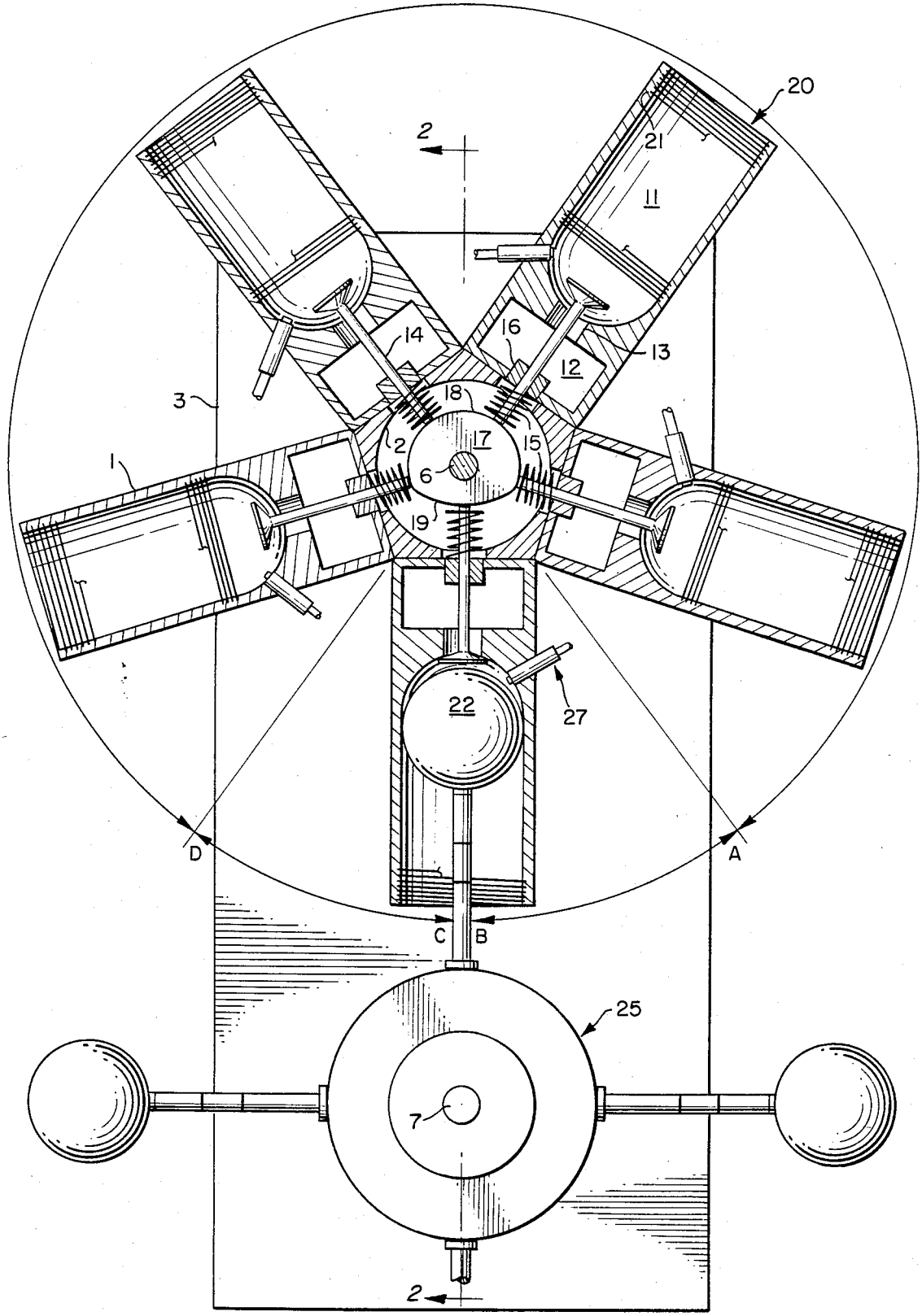
FIG. 1 is a vertical section through the rotary diesel engine taken at right angles to the rotor axes.
Figure 2:
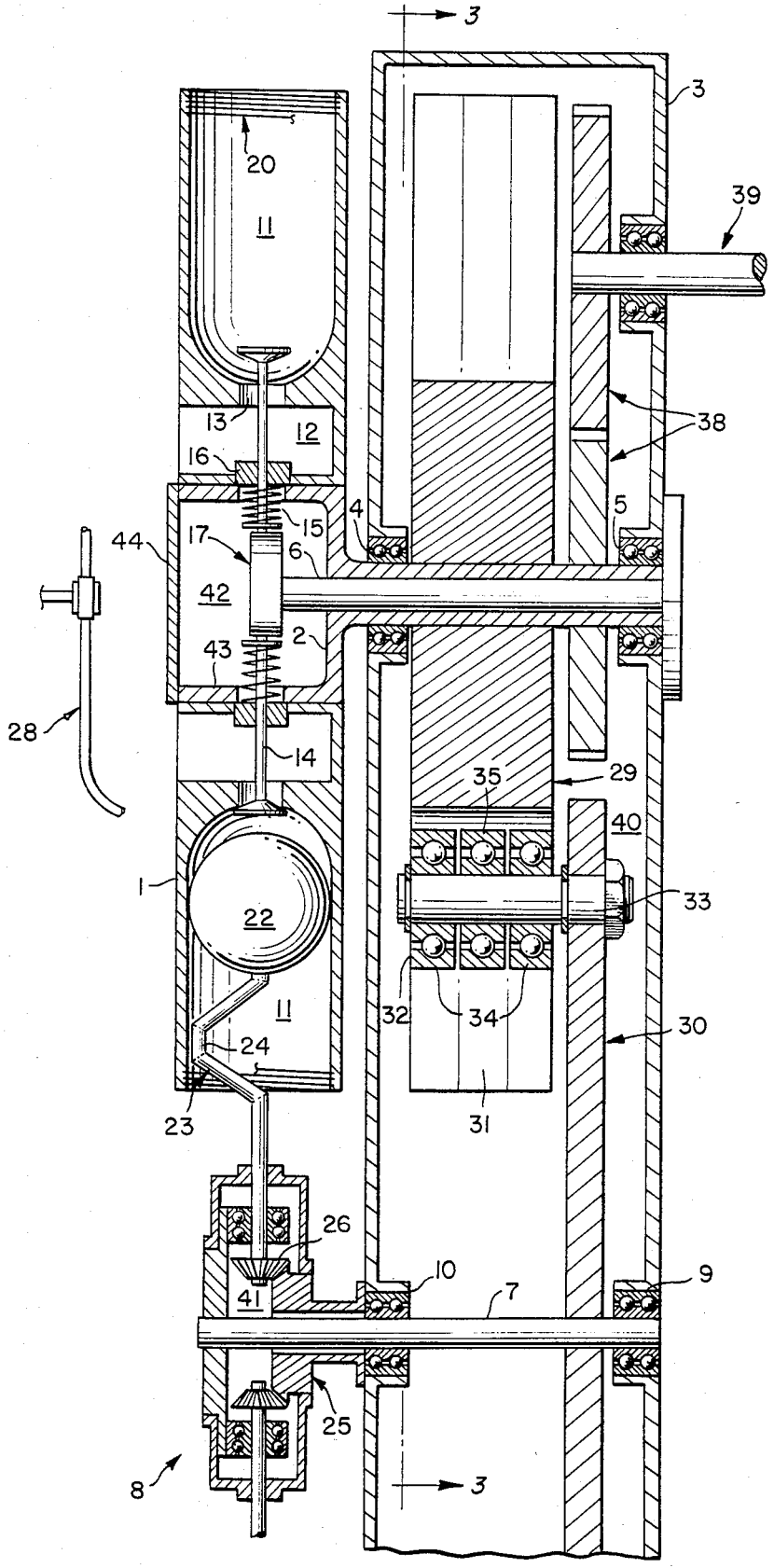
FIG. 2 is a detailed sectional view of FIG. 1 taken substantially along the line 2—2 of FIG. 1.

Referring to the drawings, and particularly to FIGS. 1 and 2, there is shown a combustion chamber rotor assembly 1 mounted for rotation on hub 2 journalled in a gear box 3 in appropriate bearings 4 and 5. The rotor hub 2 has five exterior sides 43 and a pentagonally shaped end cover 44. Within the hub 2 is shaft 6. A second shaft 7 extending through gear box 3 and parallel to shaft 6 has mounted thereon a rotary piston assembly 8 suitably journalled in bearings 9 and 10. The rotor 1 has five circumferentially spaced combustion chambers 11 each mounted on one side 43, each being cylindrical in shape. Each of the chambers 11 is charged with air through an air intake port 12. The port 12 communicates with chamber 11 by means of an inlet valve opening 13. A valve stem 14 is loaded by a valve spring 15 through a valve guide 16 so that the inner surface of the valve stem 14 rides directly on a stationary cam 17. The cam 17 is centrally mounted in rotor hub 2 and is profiled to have a curvilinear surface, partially circular 18 and partially flattened 19 which operate the valve to seal the combustion chambers 11 during the critical portion of the chamber's orbit. The chambers 11 are each provided with a helical sealing ring 20 seated in a helical groove 21 on the inside surface of the chamber.

The piston assembly 8 has four spherical pistons 22, which orbit in a direction opposed to that of the chamber rotor 1. The pistons 22 interdigitate with the combustion chambers 11 during approximately 90° of rotation of one of the pistons and 72° of rotation of one of the combustion chambers. Each piston 22 has a connecting rod 23 of special significant shape, specifically the central portion has a double bend or "crank" shape 24, which is attached to the rod rotation differential 25. The piston and rod are driven during the power stroke to rotate longitudinally 180° and thus drive the piston shaft 7 by means of the gear assembly 26.

Figure 3:
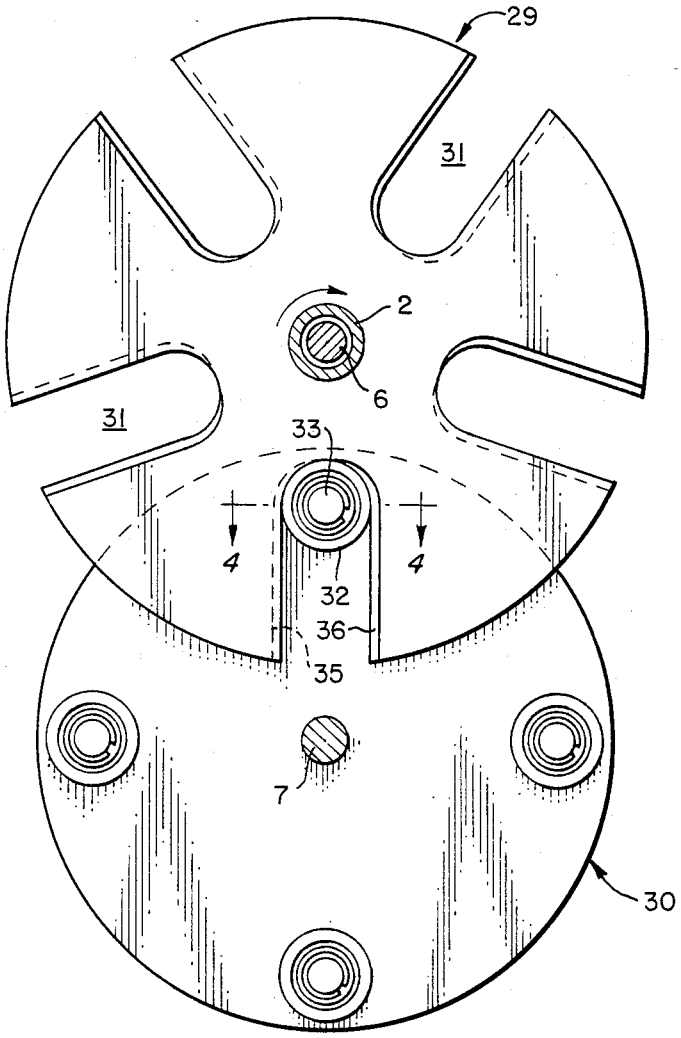
FIG. 3 is a sectional view of FIG. 2 taken along the line 3—3 illustrating the cam wheel and cam wheel follower.
Figure 4:
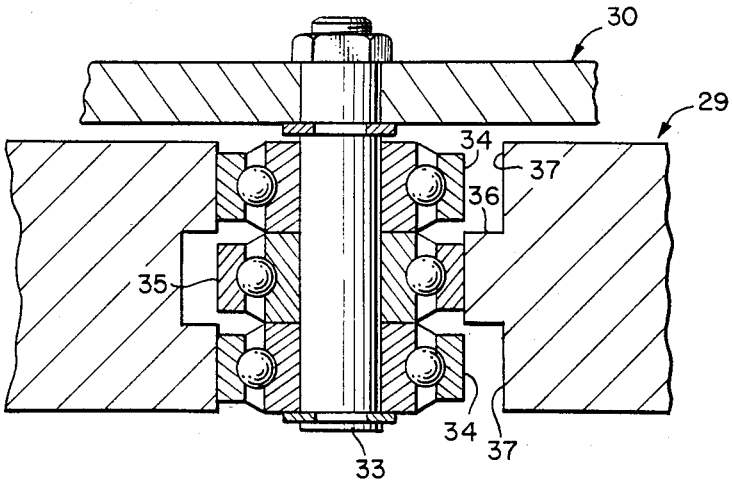
FIG. 4 is an enlarged sectional view taken along line 4—4 of FIG. 3 showing the cam and follower relationship.

A diesel fuel injection nozzle 27 penetrates the top side wall of each chamber 11. The fuel feeds from the fuel line 28 as shown in FIG. 2. A cam wheel 29 and cam follower wheel 30, shown in FIG. 2 and 3, lie inside the gear box 3. The cam wheel 29 is affixed to rotor hub 2 surrounding shaft 6 and rotates synchronously with the combustion chamber rotor assembly 1. Five slots 31 are equally spaced in a radial disposition around the circumference of the cam wheel 29. Each of the slots is aligned with one of the combustion chambers 11 and is a width equal to the diameter of one of the pistons 22. The cam follower wheel 30 is affixed to shaft 7 and revolves therewith. As shown in FIG. 4, the cam follower wheel 30 supports four cam follower units 32 each press-fitted to a follower wheel shaft 33 which is spaced at 90° intervals around the periphery of follower wheel 30. The cam follower units 32 each has two parallel spaced apart roller followers 34 sandwiching between them roller follower 35. The roller followers 34 and 35 have the same diameter as the piston 22. The cam slots 31 are indented to provide a central segment 36 and two step-down portions 37, which engage follower members 35 and 34 respectively. The cam follower members 34 are engaged by cam slots 31 on the power stroke and transmit the energy from the piston unit to the combustion chamber unit and at the same time through a conventional gear arrangement 38 to an output shaft 39. On the compression stroke the cam follower 35 receives energy from the combustion unit and transmits it via shaft 7 and differential 25 to the piston unit.

In the two-stroke cycle operation of the engine, combustion chamber 11 is charged with air through air intake 12. Orbiting of the combustion units create air flow due to centrifugal force on the moving air. Spring-loaded valve 14 operated by stationary cam 17 seals the combustion chamber for 72° of rotation of the combustion units. The piston 22 enters the combustion chamber through the open end and compresses the air during the next 36° of the rotor cycle, arrow A-B. Fuel is injected and ignites. The piston exits from the combustion chamber in the next 36° of rotation, arrow C-D, propelled by the force of the combusted gases. At this point the valve opens and fresh air forces out the burned gases. The arrangement of five combustion chambers and four pistons permit the extent ot angular movement of the pistons to be greater than that of the combustion chambers to give maximum power and compression stroke lengths. During the engagement of a piston with a combustion chamber the ratio of the angular velocity of the piston to the angular velocity of the combustion chamber is approximately 1:1 at the entry and exit points. This ratio decreases from the entry point to the dead center location and increases from the dead center location to the exit point. This ratio is controlled by the cam system. The improved, longer piston stroke is made possible by the combined effects of the double bend in the connecting rod and the rotation thereof. The combustion chamber cylinders 11 are lubricated from diesel fuel injection, the fuel itself being oily. Lubrication to the interior of the gearbox 40, connecting rod differential chamber 41 and rotor hub interior 42 is accomplished through splash lubrication as each of these is a sealed area.

While the invention has been described in its preferred embodiment, various changes and modifications may be resorted to without departing from the scope of the invention.

What is claimed is:

1. A rotary diesel engine comprising:

five circumferentially spaced, radially distributed combustion chambers mounted on a central hub to orbit in one direction;

four circumferentially spaced radially extending spherical pistons mounted to rotate in a coplanar orbit in the opposing direction;

piston connection rods having one end affixed to a piston, and other end connected to a rod rotation differential for rotating the piston elements and rods about the longitudinal axis of the rods, and cam and cam follower wheel arrangement mounted parallel to the combustion chamber and piston unit in a gearbox to transfer energy between these units during the interdigitation of the pistons and combustion chambers.

2. A rotary diesel engine as defined in claim 1 wherein the piston connecting rods have a central double bend in a "crank" shape for clearance as the pistons enter and exit the combustion chambers.

3. A rotary diesel engine as defined in claim 2 wherein the connecting rods and pistons longitudinally rotate 180° while orbiting 90° of their circular path.

4. A rotary diesel engine as defined in claim 3 wherein each combustion chamber communicates with an air intake port by means of a spring-loaded valve having a valve stem riding on a stationary cam mounted in the central hub.

5. A rotary diesel engine as defined in claim 4 wherein the combustion chambers have a helical sealing ring seated in a helical groove on the inside of the chamber.

6. A rotary diesel engine as defined in claim 3 wherein said cam wheel has five radially extending slots of the same width as the piston diameter and said cam follower wheel has four peripherally located follower units of the same diameter as the piston diameter for sequentially engaging the cam slots as these wheels rotate.

7. A rotary diesel engine comprising:

a rotatable combustion chamber unit having radially disposed cylindrical chambers orbiting about a central hub;

a piston unit having one less number of pistons than the number of chambers consisting of spherical pistons circumferentially spaced and radially extending about a central shaft parallel to the first hub and orbiting in the opposed direction;

connecting rods joining the pistons to a rod rotation differential, which rotates both rod and piston about the longitudinal axis of the rod, and cam wheel and cam follower means mounted parallel to the combustion chamber and piston units to transfer energy between these units during the interdigitation of the pistons and combustion chambers in the course of a two-stroke cycle.

8. A rotary diesel engine as defined in claim 7 wherein the connecting rods have a central double bend in a "crank" shape for clearance as the pistons enter and exit the combustion chambers.

9. A rotary diesel engine as defined in claim 8 wherein the connecting rods and pistons longitudinally rotate 180° while orbiting in their circular path.

10. A rotary diesel engine as defined in claim 9 wherein each combustion chamber communicates with an air intake port by means of a spring-loaded valve having a valve stem riding on a stationary cam mounted in the central hub.

11. A rotary diesel engine as defined in claim 10 wherein the combustion chambers have a helical groove on the inside surface of the chamber holding a helical sealing ring.

12. A rotary diesel engine as defined in claim 11 wherein said cam wheel has radially extending slots of equal number to the number of combustion chambers, each slot being the same width as the piston diameter and said cam follower wheel has a number of peripherally spaced follower units equal to the number of pistons and of the same diameter as the pistons for sequentially engaging the cam slots as these wheels rotate.

* * * * *